US005344133A

United States Patent [19]

Jantsch et al.

[11] Patent Number: 5,344,133

[45] Date of Patent: Sep. 6, 1994

[54] VACUUM BELT FEEDER HAVING A POSITIVE AIR PRESSURE SEPARATOR AND METHOD OF USING A VACUUM BELT FEEDER

[75] Inventors: Gregory R. Jantsch, Macedon; James D. Shifley, Spencerport; Michael T. Dobbertin, Honeoye; Theophilus C. Wituszynski, Fairport; Larry J. Mortellaro, Batavia; Henry P. Mitchell, Jr., Rochester, all of N.Y.

[73] Assignee: Eastman Kodak Company, Rochester, N.Y.

[21] Appl. No.: 23,032

[22] Filed: Feb. 25, 1993

[51] Int. Cl.[5] ..... B65H 3/12

[52] U.S. Cl. ..... 271/94; 271/98; 271/104; 271/105; 271/164; 271/171

[58] Field of Search ..... 271/97, 98, 104, 105, 271/106, 30.1, 160, 162, 164, 94, 171

[56] References Cited

U.S. PATENT DOCUMENTS

| | | | |
|---|---|---|---|
| 4,169,676 | 10/1979 | Kaiser | 356/39 |
| 4,184,672 | 1/1980 | Watkins et al. | 271/105 |
| 4,327,906 | 5/1982 | Frohlich et al. | 271/103 |
| 4,374,212 | 2/1983 | Martellock et al. | 523/212 |
| 4,381,860 | 5/1983 | Silverberg | 271/10 |
| 4,451,028 | 5/1984 | Holmes et al. | 271/11 |
| 4,589,647 | 5/1986 | Roller | 271/94 |
| 4,596,385 | 6/1986 | Silverberg | 271/94 |
| 4,627,605 | 12/1986 | Roller et al. | 271/94 |
| 4,635,921 | 1/1987 | Thomas | 271/94 |
| 4,678,176 | 7/1987 | Roller | 271/94 |
| 4,750,729 | 6/1988 | Kanoto et al. | 271/162 |
| 4,887,805 | 12/1989 | Herbert et al. | 271/94 |
| 5,090,676 | 2/1992 | Matsuno et al. | 271/98 X |
| 5,092,578 | 3/1992 | Bergmeier et al. | 271/97 |
| 5,150,892 | 9/1992 | Shimizu | 271/98 |
| 5,181,706 | 1/1993 | Yamamoto et al. | 271/98 X |
| 5,181,709 | 1/1993 | Okada et al. | 271/97 |
| 5,181,710 | 1/1993 | Takata et al. | 271/98 |

*Primary Examiner*—Robert P. Olszewski
*Assistant Examiner*—Boris Milef
*Attorney, Agent, or Firm*—Lawrence P. Kessler

[57] ABSTRACT

Apparatus for feeding sheets seriatim from a sheet supply stack. The apparatus comprises a sheet feed head assembly including a plenum, a vacuum source in flow communication with the plenum, and a mechanism, such as a feed belt, for example, associated with the plenum for urging a sheet acquired by vacuum in a sheet feeding direction away from the sheet supply stack. The sheet supply stack is supported, for example in a hopper on a support platform, so as to maintain the topmost sheet in such stack at a predetermined level in spaced relation with respect to the urging mechanism of the sheet feed head assembly. A first positive air supply directs a flow of air at the sheet supply stack to levitate the top several sheets in the supply stack to an elevation enabling the topmost sheet to be acquired by vacuum from the sheet feed head assembly plenum; and a second positive air supply directs a flow of air at an acquired sheet to assure separation of any additional sheets adhering to such topmost sheet.

28 Claims, 6 Drawing Sheets

VACUUM BELT FEEDER HAVING A POSITIVE AIR PRESSURE SEPARATOR AND METHOD OF USING A VACUUM BELT FEEDER

BACKGROUND OF THE INVENTION

The present invention relates in general to sheet handling apparatus for reproduction apparatus for example, and more particularly to a receiver sheet supply and feed apparatus, including a vacuum corrugation belt feeder and a positive air pressure separator.

In typical reproduction apparatus such as copiers or printers, for example, information is reproduced on individual cut sheets of receiver material such as plain bond paper or transparencies. Such receiver sheets are stored in a stack and fed seriatim when copies are to be reproduced. The sheet feeder for the reproduction apparatus must be able to handle a wide range of sheet types and sizes reliably and without damage. Sheets must be fed individually; that is, without misfeeds or multi-feeds.

Reproduction apparatus sheet feeders are typically of two types, vacuum feeders or friction feeders. One type of vacuum feeder is shown in U.S. Pat. No. 4, 169,676, issued Oct. 2, 1979, in the name of Russel. This vacuum feeder, commonly referred to as an oscillating vacuum feeder, includes an oscillating tube through which vacuum is applied to tack a sheet to the surface of the tube (sheet acquisition) for withdrawal from the sheet supply stack. Nip rollers, in cooperative relation with bearings on the tube downstream of sheet acquisition zone in a sheet feeding direction, urge a separated sheet from the sheet supply stack along a feed path away from the supply stack. While such feeder is considered to be highly effective, it does have some limitations in feeding extremely light or heavyweight papers. It is also noisy due to both its mechanical oscillation requirements and its need to utilize a high flow/high pressure vacuum source.

Another type of vacuum feeder is shown in U.S. Pat. No. 4,635,921, issued Jan. 13, 1987, in the name of Thomas. This vacuum feeder, commonly referred to as a vacuum corrugation feeder, includes a vacuum plenum for acquiring a sheet from a supply stack. The top sheets in the stack are levitated by fluffer (positive air pressure) jets. Ported belts entrained about the plenum are driven to transport a sheet vacuum tacked to the belts from the supply stack. This type of feeder is highly efficient but is still subject to misfeeds/multi-feeds, and has certain limitations with regard to the range of types of sheet materials that can be reliably handled.

Yet another type of vacuum feeder is shown in U.S. Pat. No. 4,184,672, issued Jan. 22, 1980, in the names of Watkins et al, and U.S. Pat. No. 4,327,906, issued May 4, 1982 in the names of Frölich et al. This type of vacuum feeder, commonly referred to as a vacuum picker or sucker, includes a plurality of cup-like structures connected to a vacuum source and movable to selectively pick up a sheet from a supply stack for transport from the stack. Such feeder requires a complicated mechanical arrangement to accomplish its desired pick up and transport function.

One type of friction feeder is shown in U.S. Pat. No. 4,374,212, issued Feb. 5, 1983, in the names of Martellock et al, and U.S. Pat. No. 4,381,860, issued May 3, 1983, in the name of Silverberg. This type of friction feeder, commonly referred to as a scuff feeder, includes a member (respectively shown as a belt or paddle wheel, but may also comprise a roller) which relies on frictional engagement with a sheet for removal of the sheet from a supply stack. Scuff feeders are of the simplest construction and are the cheapest to manufacture. However, since sheet materials exhibit a wide variation in friction characteristics, scuff feeders are the least reliable of the discussed group of feeders.

SUMMARY OF THE INVENTION

In view of the foregoing discussion, this invention is directed to an apparatus for storing a stack of sheets in a supply hopper and reliably and efficiently feeding sheets seriatim from the sheet supply stack. The apparatus comprises a sheet feed head assembly including a plenum, a vacuum source in flow communication with the plenum, and a mechanism, such as a feed belt, for example, associated with the plenum for urging a sheet acquired by vacuum in a sheet feeding direction away from the sheet supply stack. The sheet supply stack is supported so as to maintain the topmost sheet in such stack at a predetermined level in spaced relation with respect to the urging mechanism of the sheet feed head assembly. A first positive air supply directs a flow of air at the sheet supply stack to levitate the top several sheets in the supply stack to an elevation enabling the topmost sheet to be acquired by vacuum from the sheet feed head assembly plenum; and a second positive air supply directs a flow of air at an acquired sheet to assure separation of any additional sheets adhering to such topmost sheet.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
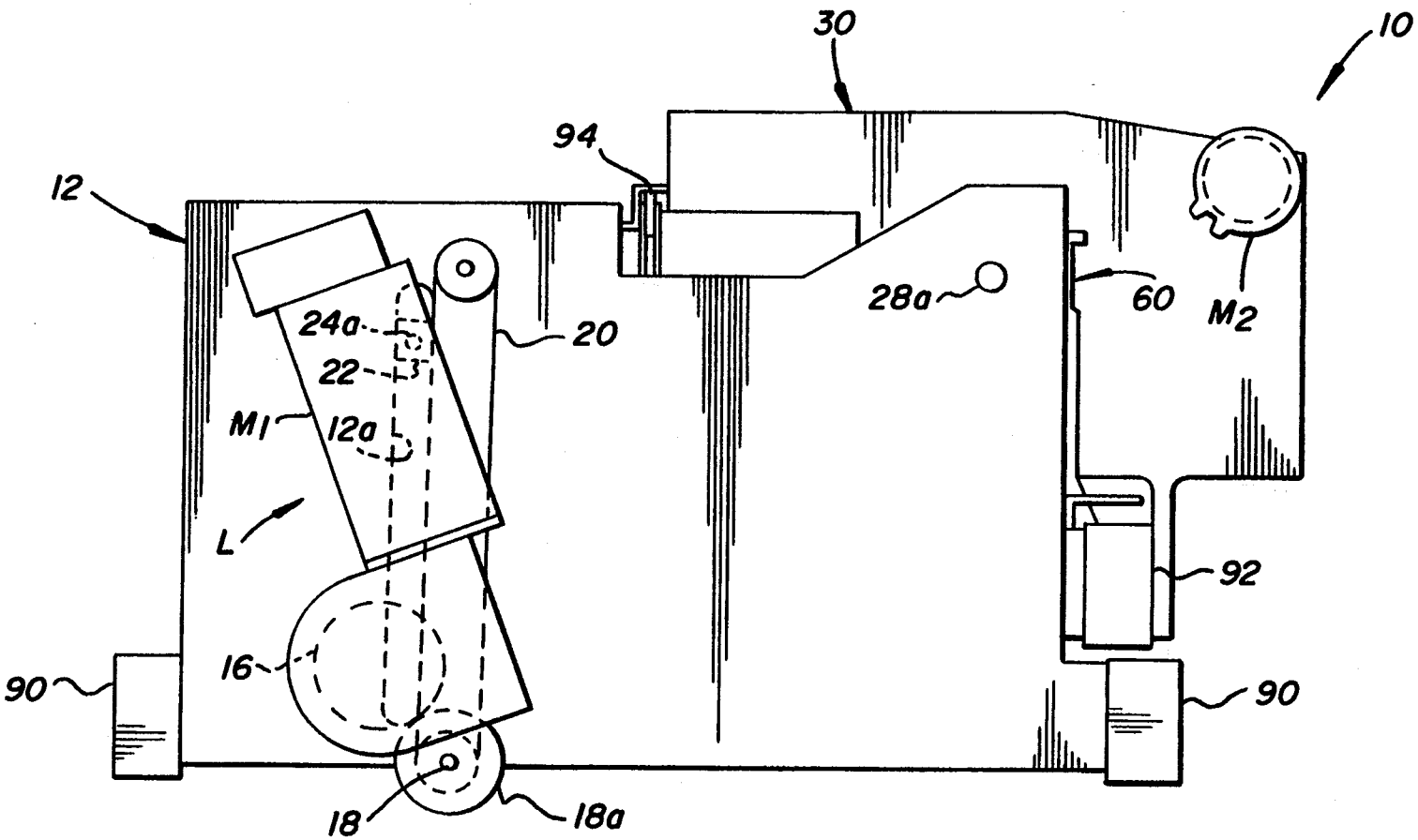
FIG. 1 is a side elevational view of the receiver sheet supply and feeding apparatus according to this invention.
Figure 2:
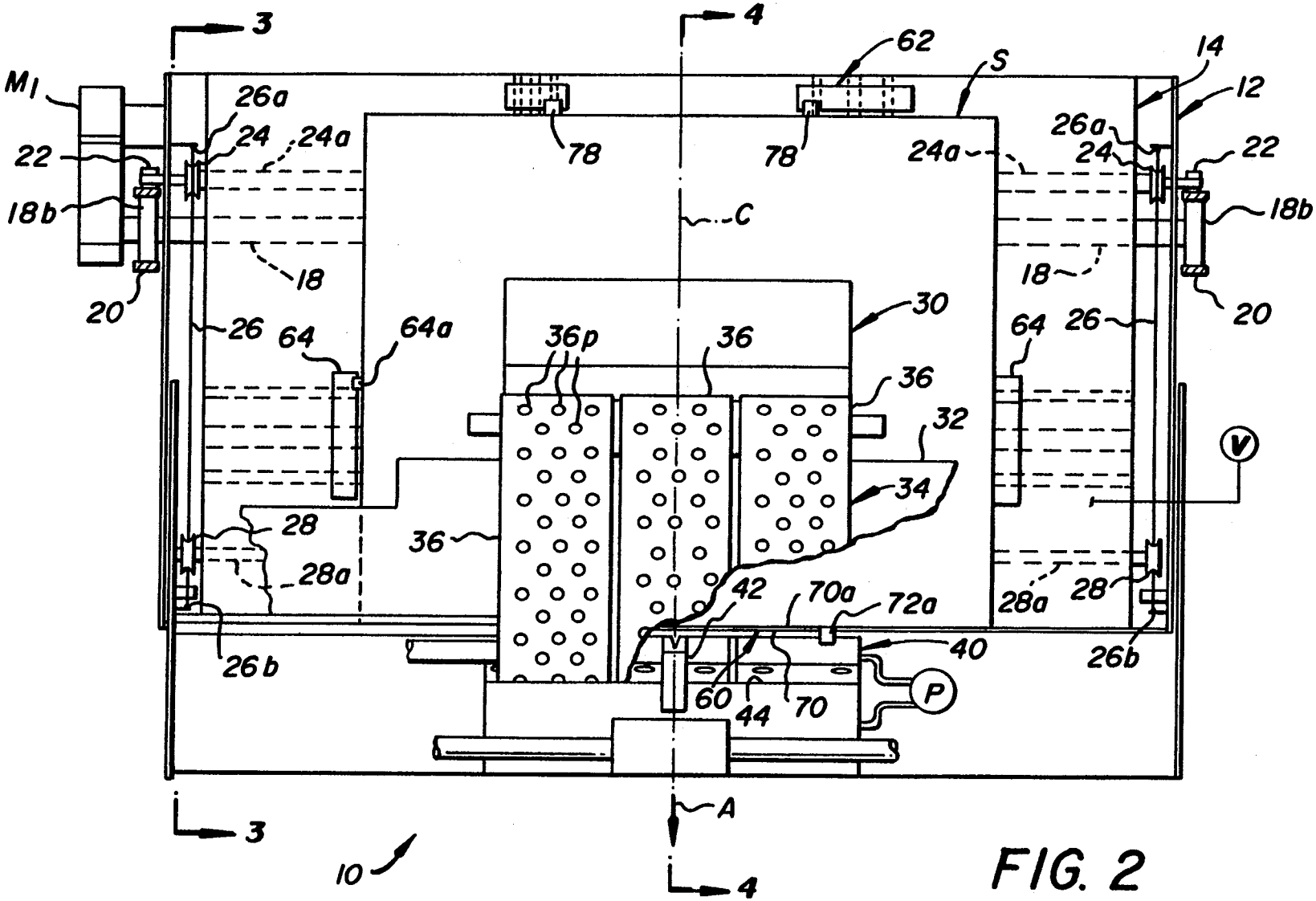
FIG. 2 is a top plan view of the receiver sheet supply and feeding apparatus of FIG. 1, with portions removed or broken away to facilitate viewing.

Referring now to the accompanying drawings, FIGS. 1 and 2 generally best show the receiver sheet supply and feeding apparatus according to this invention. The receiver sheet supply and feeding apparatus, designated generally by the numeral 10, includes an open hopper 12 and an elevating platform 14 for supporting a stack of sheets. A sheet stack (designated by the letter S) supported on the platform 14 contains individual sheets suitable, for example, for serving as receiver sheets for having reproductions formed thereon in a copier or printer device. Sheets for receiving reproductions may be selected from a wide variety of materials and sizes. For example, the sheets may be of a weight in the range of 13 pound bond to 140 pound index, and a size in the range of 8×5 inches to 11×17 inches.

The sheet stack supporting platform 14 is supported within the hopper 12 for substantially vertical elevational movement by lifting mechanism L. The lifting mechanism L serves to raise the platform 14 to an elevation for maintaining the topmost sheet in the stack S at a predetermined level during operation of the receiver sheet supply and feeding apparatus 10, and lower the platform to permit adding sheets thereto. The lifting mechanism L includes a motor $M_1$, attached to the outside of the upstanding front wall of the hopper 12 (see FIG. 1). The motor $M_1$ rotates an output gear 16 in mesh with a gear 18*a* mounted on a shaft 18 extending from the upstanding front wall of the hopper 12 through the upstanding rear wall of the hopper (see FIG. 2). A pair of pulley mounted lifting chains 20 are respectively interconnected by gears 18*b* with the shaft 18 to be moved about a closed loop path when the shaft 18 is rotated by the motor $M_1$.

Figure 3:
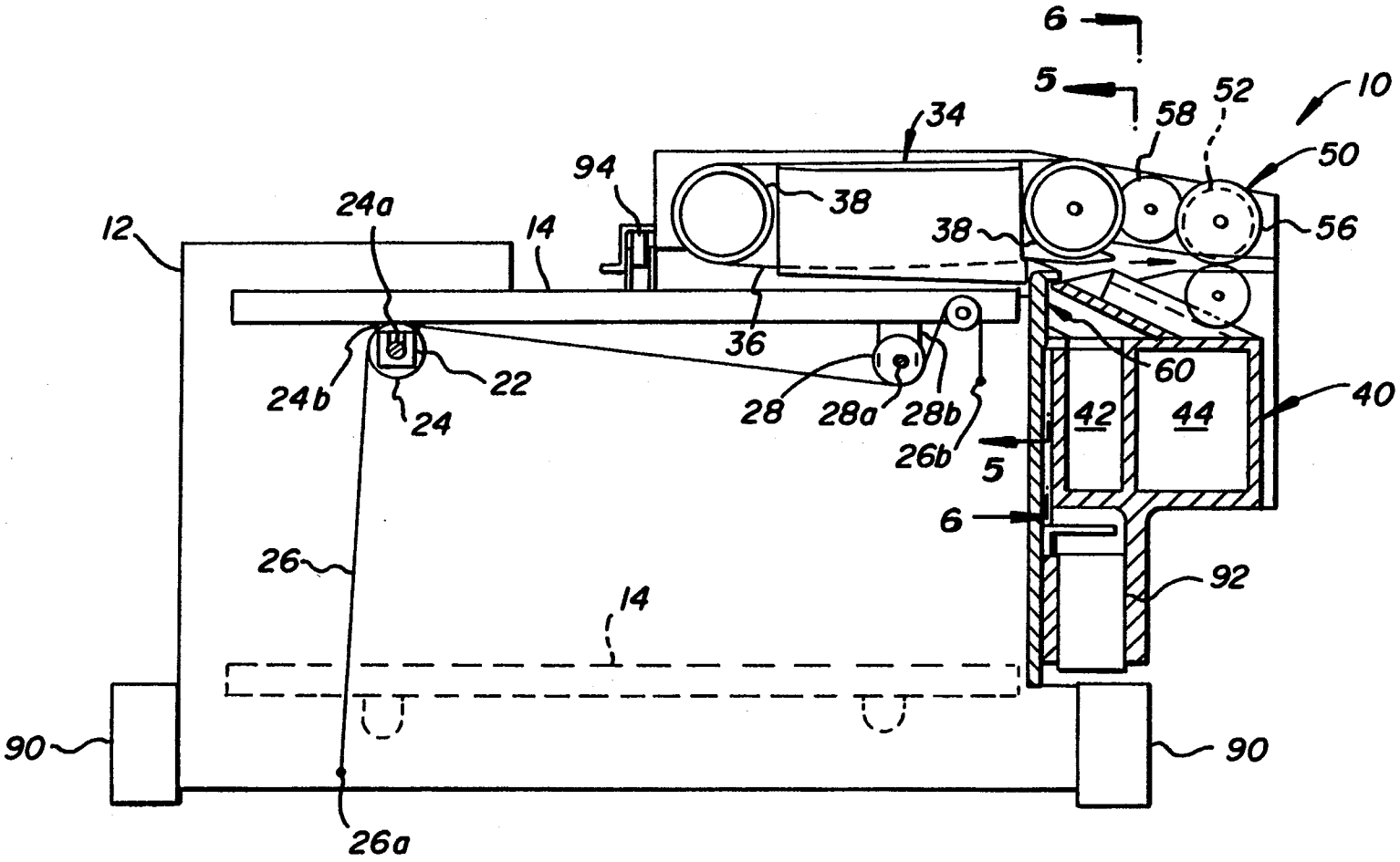
FIG. 3 is a side elevational view of a cross-section of the receiver sheet supply and feeding apparatus taken along lines 3—3 of FIG. 2, particularly showing the platform elevating mechanism.

Each of the lifting chains have a link 22 extending through a slot 12*a* respectively in the front and rear upstanding wall of the hopper 12. The links 22 are connected to respective pulleys 24 mounted on a shaft 24*a* supported in brackets 24*b* extending from the underside of the platform 14 (see FIG. 3). Tension cables 26 are respectively connected, at the ends 26*a*, 26*b* thereof, to the front and rear upstanding wall of the hopper 12. The cables are respectively threaded over their associated pulleys 24 and under pulleys 28 mounted on a shaft 28*a* supported in brackets 28*b* extending from the underside of the platform 14.

Figure 5:
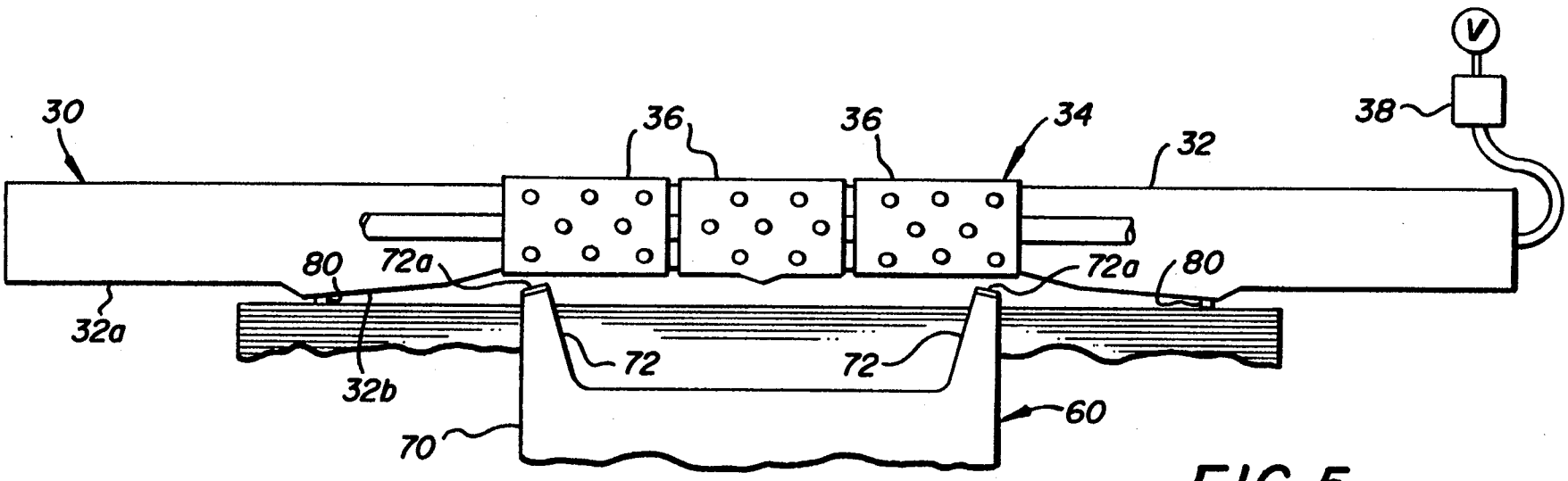
FIG. 5 is an end view, on an enlarged scale and with portions removed, of a portion of the receiver sheet supply and feeding apparatus, particularly showing the feed head assembly thereof, taken along the lines 5—5 of FIG. 3.

In FIG. 1, the sheet stack supporting platform 14 is shown in its most elevated position in solid lines, and in its lowest position in phantom. During the operation of the lifting mechanism L, an appropriate signal to the motor $M_1$ causes the motor to rotate the gear 16, either clockwise (in FIG. 1) to lower the platform 14 toward the lowest position or counterclockwise to raise the platform toward its most elevated position. Rotation of the gear 16 moves the lifting chains 20 in their closed loop paths imparting vertical movement to the links 22. This movement, in turn, moves the shaft 24*a*, and thus the platform 14 and its brackets 24*b* and pulleys 24. The platform 14 is maintained substantially level in its movement by the action of the tension cables 26 which cooperatively move the pulleys 28 and thus the shaft 28*a* and brackets 28*b* of the platform. Maintaining the topmost sheet at the predetermined level is accomplished by a sheet detecting switch 80 (see FIG. 5) which controls the operation of the motor $M_1$ for actuating the lifting mechanism L, in the manner to be explained hereinbelow, to raise the platform 14 through a predetermined increment. On the other hand, lowering of the platform 14 is usually accomplished by some externally produced signal to the motor which tells the motor to rotate for a time sufficient to bring the platform to its lowest position.

Of course, other precisely controllable lifting mechanisms, such as worm gears or scissor linkages, are suitable for use in elevation control for the sheet stack supporting platform according to this invention.

Figure 4:
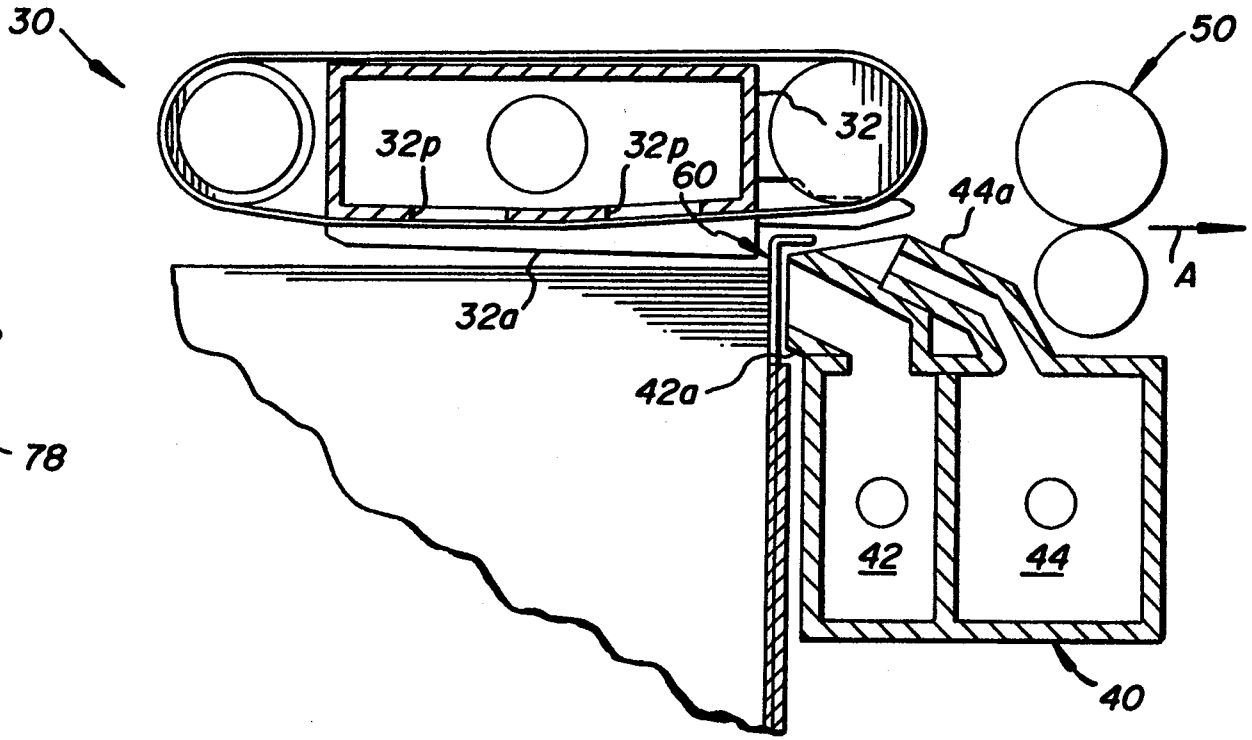
FIG. 4 is a side elevational view, on an enlarged scale and with portions removed, of a portion of the receiver sheet supply and feeding apparatus particularly showing the feed head assembly thereof.

A sheet feed head assembly, generally designated by the numeral 30, is located in association with the hopper 12 so as to extend over a portion of the platform 14 in spaced relation to a sheet stack supported thereon. The sheet feed head assembly 30 includes a ported plenum 32 connected to a vacuum source V, and an air jet device 40 connected to a positive pressure air source P. As will be more fully explained hereinbelow, according to this invention a positive pressure air jet from the device 40 levitates the top several sheets in the supported sheet stack S, vacuum at the plenum 32 is effective through its ports 32*p* (see FIG. 4) to cause the topmost levitated sheet from the stack to thereafter be acquired at the plenum for separation from the sheet stack, and additional positive pressure air jets from the device 40 assure separation of subsequent sheets from the acquired topmost sheet.

The lower surface 32*a* of the plenum 32 of the sheet feed head assembly 30 has a particularly configured shape (shown in FIG. 5) so as to provide for a specific corrugation of an acquired sheet. As the top sheets in the supported sheet stack are levitated, the topmost sheet contacts the outer winged portions 32*b* of the surface 32*a*. A minimal pressure is exerted on the cross-track marginal edges of the sheet to help in forming a controlled corrugation to the sheet. This establishes a consistent spacing for the center portion of the sheet from the center portion of the plenum 32. As such, the access time for a sheet to be acquired at the plenum is repeatably consistent and readily predictable. The interactions of the plenum 32, the air jet device 40, and a front stop (designated by the numeral 60 and more fully described hereinbelow) assure that control over the sheet as it is acquired at the plenum is never lost. Further, corrugation of the sheet contorts the sheet in an unnatural manner. Since subsequent sheets are not subjected to the same forces, at the same time, as is the topmost sheet, such subsequent sheets are unable to contort in the same manner. Accordingly, the subsequent sheets are effectively separated from the topmost sheet as it is being acquired at the plenum.

In a preferred embodiment for efficiently handling typical receiver sheets, for use in an exemplary reproduction apparatus, of a weight and a size described above, the vacuum source V may create a flow rate in the range of approximately 35 cu. ft./min. to 60 cu. ft./min., with 47–53 cu. ft./min. being optimum. A valve 38 (see FIG. 5), of the bleed-off, poppet or gravity door type for example, is used to limit the vacuum level once a sheet has been acquired at the plenum 32. Limiting of the vacuum level aides in limiting air bleed through of some porous type sheet materials. Vacuum bleed through for a porous sheet may potentially cause the undesirable condition where a subsequent sheet will adhere to the acquired sheet and result in a multi-feed.

Additionally, limiting the vacuum level reduces the amount of energy required to transport the acquired sheet forward in the sheet feed direction. That is, the vacuum induced normal forces holding the sheet to the plenum 32 are reduced so that the sheet may be more readily transported, in the manner described hereinbelow, in the feed direction with substantially less drag.

A switch 36, for example a pressure or mechanically activated switch, is attached to the plenum to detect when a sheet has been acquired. A signal provided by the switch on detection of sheet acquisition is utilized to control operation of various components of the sheet feed head assembly 30, such as timing of activations or setting of air flow levels, to optimize operation for a particular type (size) of sheet to be fed from the sheet supply and feeding 10 according to this invention.

The sheet feed head assembly 30 additionally includes a belt mechanism 34 for transporting an acquired sheet in a feed direction (designated by the arrow A in FIGS. 2 and 3) away from the sheet stack S toward a downstream location. The belt transport mechanism 34 has a plurality of belts 36 entrained about rollers 38 to establish a closed loop path about the plenum 32. The lower runs of the belts 36 are in intimate contact with the lower surface 22*a* of the plenum 22 (see FIG. 5). The acquired sheet from the sheet stack S is effectively tacked to the belts by air pressure resulting from the application of vacuum in the plenum 32 through the plenum ports 32*p* and the belt ports 36*p*.

The belts 36 are selectively driven in a direction (counter-clockwise in FIGS. 3 and 4) to remove the acquired sheet from the area above the sheet stack S and transport the sheet in the feed direction A along a travel path to a downstream transport, such as driven feed nip roller pair 50. The nip roller pair 50 is driven by a motor $M_2$. A gear 52 is rotatably mounted on a shaft 54 supporting one roller of the nip roller pair. A clutch 56 is selectively activated to couple the gear 52 to the shaft 54 for rotation with the shaft. An intermediate gear 58 is in mesh with the gear 52 and a gear (not shown) coupled to one of the belt rollers 38. Accordingly, when the clutch 56 is activated, the belts 36 will be driven so as to feed an acquired sheet such that the acquired sheet is transported from the sheet stack S and is thereafter available for any further processing, such as receiving a reproduction from a copier or printer, for example.

The hopper 12 incorporates a front stop 60, a rear stop 62 and side stops 64 arranged to engage the marginal edges of a sheet stack S supported on the platform 14 and accurately locate the sheet stack relative to the sheet feed head assembly 30. The front stop 60 additionally provides a lead edge guide for the topmost sheet in the sheet stack as it is removed from the stack for acquisition, and also serves as a retard mechanism for any sheets adhering to the topmost sheet as it is removed. The positive pressure air jet device 40 of the sheet feed head assembly 30 is located adjacent to the front stop 60 on the opposite side thereof from the sheet supporting platform 14. As noted above, the air jet device 40 is for the purpose of levitating the top sheets in the sheet stack S and separating subsequent sheets adhering to the topmost sheet when acquired for removal from the sheet stack.

The positive pressure air jet device 40 includes a first air jet arrangement 42 and a second air jet arrangement 44. The first air jet arrangement 42 incorporates a single nozzle 42*a* in flow communication with a source of positive pressure air P. The nozzle 42*a* is located substantially along the center line C (see FIG. 2) of the sheet stack S, in the cross-track direction, and is aimed at the location where the top of the sheet stack will be positioned by the sheet support platform 14. The single nozzle 42*a* directs a high pressure air stream at the sheet stack, in the center of the lead edge, to fluff the top several sheets in the stack to bring the topmost sheet into association with the sheet feed head assembly 30 where it can be acquired, by vacuum, at the plenum 32.

Figure 6:
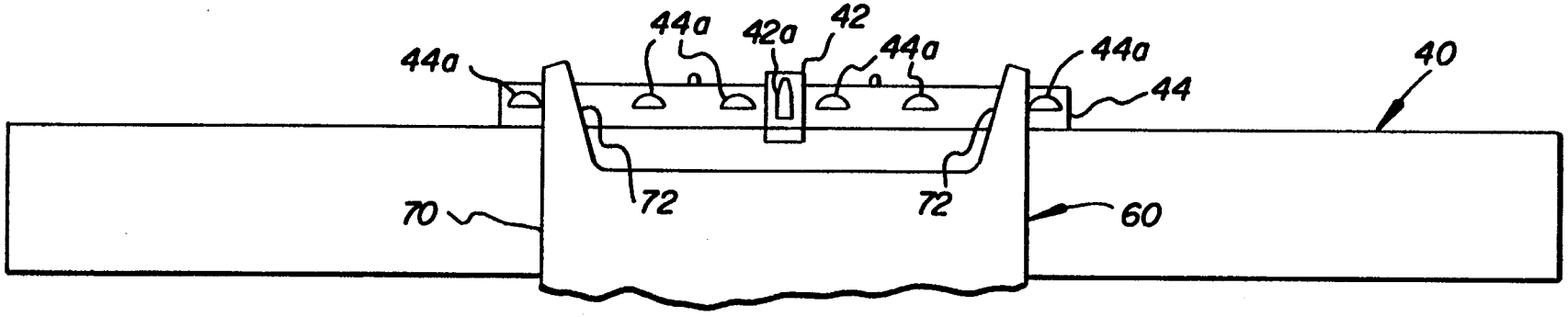
FIG. 6 is an end view, on an enlarged scale and with portions removed, of a portion of the receiver sheet supply and feeding apparatus, particularly showing the air supply jets, taken along the lines 6—6 of FIG. 3.

The cross-sectional area of the nozzle 42*a* of the first air jet arrangement 42 is shaped as a tear drop (see FIG. 6). The top portion of the tear drop is approximately ½ the dimension of the bottom portion so as to apply a larger amount of air at the bottom of the nozzle than at the top. In the preferred embodiment, the nozzle 42*a* is between 0.300 inch to .600 inch (in the vertical dimension), between, 0.075 inch to 0.250 inch across the bottom portion of the tear drop, and between 0.0375 inch to 0.125 inch across the top portion of the tear drop. The location of the nozzle 42*a* to the sheet stack supported on the platform 14 is to have the nozzle 0.125 (±0.060) inch away from the lead edge of the sheet stack and the topmost sheet in the stack approximately 0.125 (±0.060) inch below the top point of the tear drop. The nozzle, which has a substantially vertical face 42*a*', has an air channel that is oriented approximately 25° to 35° from the vertical.

With the nozzle 42*a* configured in the above described manner, the top several sheets in the sheet stack S begin separation between each sheet and the topmost sheet rises, along its center line C in the feed direction A, to a controlled height above the sheet stack. The positive air flow through the nozzle can be pulsed from a low to a high flow rate, or may be left on at a high flow rate. Again, referring to the preferred embodiment, the air flow is in the range of between 1.5 cu. ft./min. to 4.5 cu. ft./min., with 1.75 cu. ft./min. being optimum. It has been found that air volume, velocity, and sheet weight can all vary within the described limits and still provide a consistent and controlled height to the levitated topmost sheet. Once the sheets have started to levitate (fluff up) in the center, the topmost sheet will rise to the outside corrugation points of the plenum 32. The air flow going into the stack will ideally be allowed to proceed through the stack out the rear thereof, with some finding its way out through the sides of the stack.

Of course, employing the described parameters for the first air jet arrangement 42, modifications to such air jet arrangement may be envisioned as suitable for use in the sheet feed supply and feeding apparatus 10 according to this invention. For example, two converging positive pressure air jets may be employed. Further, the nozzle may have a round or oval cross-section (although this may result in a somewhat degraded performance over the performance with the preferred tear drop shaped cross-section). Additionally, the nozzle may be integrally formed with the front stop 60.

The second air jet arrangement 44 incorporates a plurality of nozzles 44*a* (preferably six in number) in common flow communication with the source of positive pressure air P (or, alternatively, a second separate source of pressurized air). The nozzles 44*a* are aimed at the location where the top of the sheet stack will be positioned by the sheet support platform 14, and slightly downstream of the aim point for the first air jet nozzle 42*a* (see FIG. 1). The purpose of the second air jet arrangement 44 is to separate any sheets adhering to the topmost sheet acquired by the sheet feed head assembly 30 for removal and transport from the sheet stack S.

As discussed above, it has been found that subsequent sheets adhering to the acquired topmost sheet are not able to form the corrugations caused by the different ribs and bends of the lower surface 32*a* of the plenum 32 (as does the topmost sheet when properly acquired). Thus, pockets are formed between the topmost sheet and any subsequent adhering sheets. The air stream provided by the second air jet arrangement 44, by its location and aim, is directed into the pockets and forces the subsequent sheets back down to the sheet stack S. As such, subsequent sheets are in effect retarded and thus substantially prevented from being fed with the acquired topmost sheet, as a multi-feed condition.

In the preferred embodiment, the nozzles 44*a* of the second air jet arrangement 44 are angled approximately 25° to 35° from the horizontal face of the subsequent sheets. The nozzles 44*a* have a cross-sectional area in the shape of a semicircle (see FIG. 6). This enables the bottom of the air streams from the respective nozzles focused such that it is aimed within approximately 0.125 inch from the lead edge of the topmost sheet acquired by the plenum 32. The cross-sectional area of the nozzles is respectively between 0.0122 sq. in. and 0.0382 sq. in. The air flow for each of the plurality of nozzles 44*a* is, as in the case of the air flow for the nozzle 42*a* of the first air jet arrangement 42, in the range of between 1.5 cu. ft./min. to 4.5 cu. ft./min., with 1.75 cu. ft./min. being optimum. Accordingly, the total air flow is in the range of between 9–27 cu. ft./min., with 10.5 cu. ft./min. being optimum. The air flow may be pulsed from an off or medium flow rate to a high flow rate.

Turning now to a more detailed description of the front stop 60, the front stop comprises a plate 70 having a surface 70*a* against which the lead edge of the stack of sheets S is positioned to accurately locate the stack, in the sheet feed direction, relative to the sheet feed head assembly 20. The plate 70 has a pair of upstanding fingers 72. The fingers 72 serve to maintain the in-track position of the sheets of the stack as the sheets are levitated by the first air jet arrangement 42. That is, the topmost sheet and a number of subsequent sheets levitate, but are kept from moving forward relative to the sheet stack S by the fingers 72. The tops 72*a* of the fingers are configured to have an angle substantially equal to the corrugation of the plenum surface 32*a* respectively adjacent thereto. This establishes a restricted sheet passage (see FIG. 5) through which only a properly corrugated sheet can pass. Any subsequent sheets adhering to the topmost acquired sheet will not have the proper corrugation, as explained above, and will be blocked by the fingers 72 so that they will not be able to be transported away from the sheet stack. If not for the fingers, the subsequent sheets could be dragged forward during transport of the topmost sheet by the belts 36 creating a multi-feed condition or incorrectly locating the subsequent sheets for the beginning of the next feed cycle. The spacing of the fingers 72 is selected to enable substantially free positive air flow from the first and second air jet arrangements 42, 44 therebetween.

Figure 8:
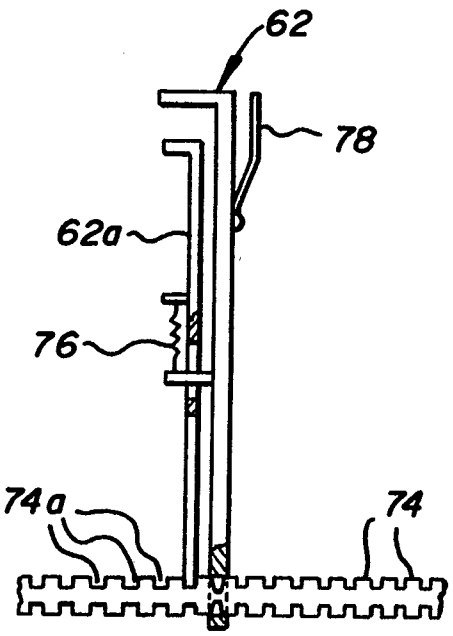
FIG. 8 is a side elevational view, partly in cross-section, of a side/rear guide of the sheet supply and feeding apparatus according to this invention.

As noted above, the hopper 12 also incorporates a rear stop 62. The rear stop 62 is necessary to prevent sheets levitated from the sheet stack S by the first air jet arrangement 42 from moving toward the rear (relative to the sheet stack) by the positive air pressure exerted on the sheets. The rear stop 62 is adjustably mounted (on guide rods for example) for selective positioning in the sheet feed direction A so as to positively engage the rear edge of a sheet stack, of any of a variety of dimensions in the sheet feed direction, supported on the platform 14 and engaged at its lead edge with the front stop 60. As best shown in FIG. 8, the rear stop 62 is also supported on an index rod 74. The rear stop is manually movable along the guide and index rods to a selected position corresponding to a dimension of the sheet stack in the in-track direction (measured from the front stop 60). The rear stop 62 is locked in the selected position by a member 62*a* interconnected to the rear stop by a tension spring 76. The spring 76 urges the lead edge of the member 62*a* into positive locking engagement with a selected one of a plurality of grooves 74*a* spaced along the index rod 74. Adjustment of the rear stop 62 is thus accomplished by manually moving the member 62*a* against the urging of the spring 76 out of association with the grooves and then sliding the stop along the index rod 74. When the rear stop 62 is correctly positioned along the rods, the member 62*a* is then released and will engage a corresponding groove of the index rod 74 to lock the rear stop in the desired position.

The rear stop 62 also includes a loading device 78, such as a leaf spring. The purpose of the loading device 78 is to exert a pressure on the top portion of the sheet stack S (and the levitated sheets) to assure that the sheets are maintained against the front stop 60. As such, the levitated sheets are maintained in their position relative to the sheet stack against the fingers 72 of the front stop 60. However, it is an important aspect of this invention that the positive air flow from the air jet device 40 between the levitated sheets be allowed to escape from the rear of the sheets. If the air flow were to be restricted, the corrugation of the topmost sheet will become unpredictable and thus the efficiency in acquiring the sheet by the sheet feed s head assembly 30 will be substantially reduced. Accordingly, the rear stop 62 is formed as two substantially identical assemblies spaced apart on opposite sides of the supported sheet stack center line C. Of course, a single assembly with a large opening spanning the area through which the air flow can pass substantially unrestricted is also suitable for use with this invention.

A sensor SN is utilized to detect the position of the rear stop 62. From the detected position, it is possible to determine the in-track dimension of the sheets in the sheet stack S and optimize timing of functions related to the feeding of sheets seriatim from the stack. It should be noted that the side stops 64 are of generally the same construction as that of the rear stop 62 (the exception being that only one of the side stops includes a loading device). Similar sensors are used to detect the positions of the side stops for determining, for example, the cross-track dimension of the sheet stack supported on the platform 14.

As noted above, it is important to the proper operation of the sheet supply and feeding apparatus 10 according to this invention for the level of the topmost sheet in the stack supported on the platform 14 to be maintained at a predetermined height relative to the plenum 32. The level is selected to be in a range where the topmost sheet, when levitated by the first air jet arrangement 42, is close enough to the plenum 32 to be readily acquired by the vacuum forces from the plenum within a repeatable time frame, and far enough away from the plenum to assure that the sheet being acquired is not pinned by the plenum. Pinning of the sheet would result in misfeeds or skew.

The switch 80, as noted above, is for the purpose of detecting the level of the topmost sheet. Such switch (see FIG. 5) is, for example, a pin that rides against the sheet, with very little downward pressure, at the highest level of acceptable corrugation. The pin is integrated into a hall effect switch so as to cause limited pressure on the sheet. The switch 80 is made during the feed cycle of the sheet feed head assembly 30 and read during the feed interval to effect raising of the platform 14 to maintain the proper sheet level. The location of the switch 80 at the highest level of acceptable corrugation is an advantage in that the switch will sense the location of sheets which may be severely curled and still not pin the sheet to the plenum. The switch 80 may also be used to determine the weight (thickness) of the receiver sheets being fed from any particular stack on the platform 14. Signals from the switch 80 can be interpreted to determine the number of sheets fed from the sheet stack per incremental elevation of the platform 14. Such number is directly relatable to the weight of the sheet material. The weight of the sheet material is a useful parameter to know when setting air (pressure or vacuum) levels for optimum operation of the sheet supply and feeding apparatus 10.

Another important aspect of the supply and feeding apparatus 10 according to this invention is that the hopper 12 and the sheet feed head assembly 30 are cooperatively associated so as to be selectively movable either together or independently. The purpose of such association is to enable the hopper 12 to be readily accessed for placement of a stack of sheets therein, and to enable the entire supply and feeding apparatus 10 to be readily accessible for maintenance or jam clearance. As particularly discussed above, the supply and feeding apparatus 10 is typically associated with a reproduction apparatus for providing sheets thereto for enabling copies to be made on such sheets. The supply and feeding apparatus 10 is normally precisely located at an operative position within the frame of the reproduction apparatus in a predetermined alignment to assure feeding of sheets along an established feed path. However, under certain circumstances, such as loading the hopper 12 or clearing jams, the various components of the apparatus 10 must be readily accessible by an operator. Generally, this requires that the apparatus 10 be movable to a position remote from the operative position (e.g., external to the reproduction apparatus).

Figure 7:
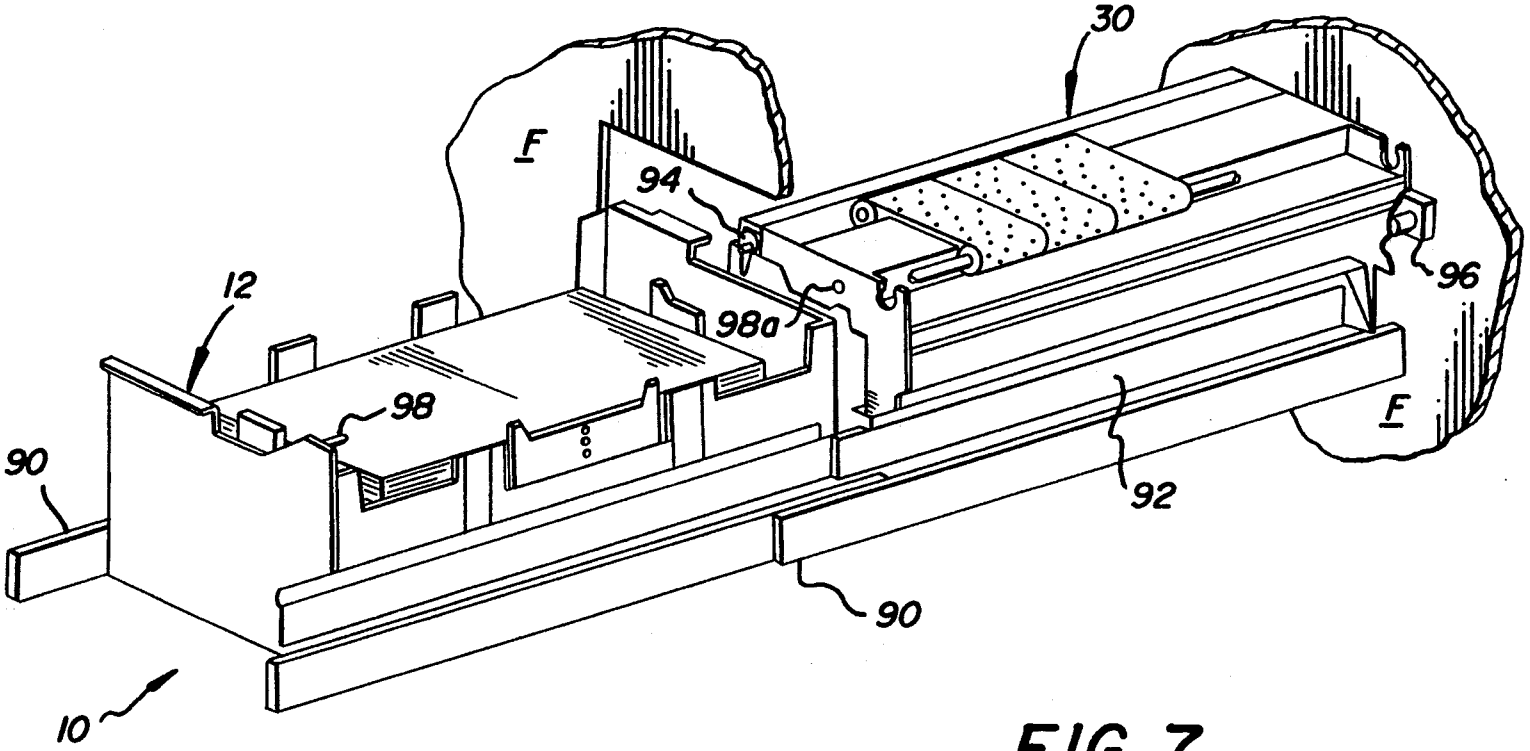
FIG. 7 is a view, in perspective, of the sheet supply and feed apparatus, according to this invention, in association with a typical reproduction apparatus, the hopper of the sheet supply and feed apparatus being in its remote location, portions being removed or broken away to facilitate viewing.

Accordingly, as shown in FIG. 7, the supply and feeding apparatus 10 is mounted on slide rails 90 which are supported within the frame F of an exemplary reproduction apparatus. In turn, the sheet feed head assembly 30 is mounted in a slide rail 92, and on roller assembly 94, supported by the hopper 12. A passive latch 96, such as a magnet or spring detent assembly, for example, releasably couples the sheet feed head assembly 20 to the frame F of the reproduction apparatus. The strength of the passive latch 96 is set to assure that it will normally overcome the forces of the hopper 12 moving in the slide rails 90 to hold the assembly 30 at the operative position. In this manner, when the hopper 12 is moved in the slide rails 90 to its remote position for loading of a sheet stack therein, the sheet feed head assembly 30 is retained within the apparatus, with the roller assembly serving to help in the support of the sheet feed head assembly. Thus, the interior of the hopper 12 is readily accessible for loading of the sheet stack on the platform 14. However, for jam clearance or general maintenance, the sheet feed head assembly 30 can be manually urged to overcome the passive latch such that the assembly moves on the slide rail 92 and roller assembly 94 to the remote location with the hopper 12 for ready access. It is pointed out that the hopper 12 has a tapered pin 98 extending from the upstanding wall away from the front of the reproduction apparatus. The pin 98 is aligned with a hole **98*a* defined in the sheet feed head assembly 30. Receipt of the pin 98 in the hole 98*a* assures the accurate alignment of the sheet feed head assembly with the hopper to establish a unitary arrangement. On return to the operative position within the reproduction apparatus, the hopper 12 and the sheet feed head assembly 30** are moved substantially together.

The invention has been described in detail with particular reference to preferred embodiments thereof, but it will be understood that variations and modifications can be effected within the spirit and scope of the invention as set forth in the claims.

What is claimed is:

1. Apparatus for feeding sheets seriatim from a sheet supply stack, said apparatus comprising:

a sheet feed head assembly including a plenum, a vacuum source in flow communication with said plenum, and means associated with said plenum for urging a sheet acquired by vacuum in a sheet feeding direction away from the sheet supply stack;

means for supporting the sheet supply stack so as to maintain the topmost sheet in such stack at a predetermined level in spaced relation with respect to said urging means of said sheet feed head assembly;

first positive air supply means for directing a flow of air at the sheet supply stack to levitate the top several sheets in the supply stack to an elevation enabling the topmost sheet to be acquired by vacuum from said sheet feed head assembly plenum, said first air supply means including a source of pressurized air and a nozzle in flow communication with said pressurized air source of said first air supply means, said nozzle being located in a plane substantially coincident with the center of the supported sheet stack measured in a direction transverse to the sheet feed direction, and oriented so as to aim a stream of pressurized air at the top portion of a sheet supply stack supported on said stack supporting means; and second positive air supply means for directing a flow of air at an acquired sheet to assure separation of any additional sheets adhering to such topmost sheet, said second air supply means including a source of pressurized air and a plurality of nozzles in flow communication with said pressurized air source of said second air supply means said nozzles being oriented so as to aim a stream of pressurized air with a component in the direction opposite to the sheet feeding direction, toward the sheet supply stack, substantially parallel to the air stream of said first air supply means and downstream of the aim of the air stream of said first air supply means.

2. The sheet feeding apparatus of claim 1 wherein said pressurized air source of said first air supply means is selected to provide a stream of pressurized air of sufficient flow to travel through the supported stack and exit at the rear of such stack in a direction opposite to the sheet feed direction.

3. The sheet feeding apparatus of claim 2 wherein said pressurized air source of said first air supply means is selected to provide a stream of pressurized air of a flow in the range of approximately between 1.5–4.5 cu. ft./min.

4. The sheet feeding apparatus of claim 1 wherein said nozzle of said first air supply means is of a cross-sectional shape substantially approximating a tear drop.

5. The sheet feeding apparatus of claim 4 wherein the tear drop shape of said nozzle of said first air supply means is such that the dimension at the top portion of the tear drop is approximately one-half the dimension of the bottom portion of the tear drop.

6. The sheet feeding apparatus of claim 1 wherein said vacuum source is selected to provide an air flow in the range of approximately between 35–60 cu. ft./min.

7. The sheet feeding apparatus of claim 1 wherein said sheet supply stack supporting means includes a platform for supporting the supply stack of sheets, and a front stop, side stops, and an adjustable rear stop for accurately locating the sheet supply stack on said platform.

8. The sheet feeding apparatus of claim 7 wherein said front stop includes a pair of spaced upstanding fingers for guiding levitated top sheets of the sheet supply stack while permitting substantially unimpeded flow of air from said first positive air supply means therebetween.

9. The sheet feeding apparatus of claim 7 wherein said rear stop includes means for urging the top sheets in the sheet supply stack toward said front stop.

10. The sheet feeding apparatus of claim 9 wherein said urging means of said rear stop is a leaf spring.

11. The sheet feeding apparatus of claim 1 wherein said plenum of said sheet feed head assembly includes a corrugation surface facing a sheet supply stack on said stack supporting means.

12. The sheet feeding apparatus of claim 11 wherein said sheet urging means of said sheet feed head assembly includes at least one belt entrained for movement about a closed loop path, said plenum being located within such closed loop path.

13. The sheet feeding apparatus of claim 11 wherein said sheet supply stack supporting means includes a platform for supporting the supply stack of sheets and a front stop for accurately locating the sheet supply stack on said platform, said front stop including a pair of spaced upstanding fingers for guiding levitated top sheets of the sheet supply stack while permitting substantially unimpeded flow of air from said first positive air supply means therebetween, said upstanding fingers having a top surface substantially conforming to the shape of said plenum corrugation surface adjacent to thereto.

14. The sheet feeding apparatus of claim 1 wherein said plurality of nozzles respectively are of substantially semicircular cross-section.

15. The sheet feeding apparatus of claim 1 wherein said pressurized air source of said second air supply means is selected to provide a stream of pressurized air in the range of approximately between 1.5–4.5 cu. ft./min. for each of said plurality of nozzles.

16. The sheet feeding apparatus of claim 1 wherein said sheet feed head assembly and said sheet stack supporting means include means for coupling sheet feed head assembly and said sheet stack supporting means together to enable them to be selectively moved together transverse to the sheet feed direction to a remote location, or moved such that only said stack supporting means moved transverse to the sheet feed direction to a remote location.

17. The sheet feeding apparatus of claim 16 wherein said coupling means further includes a passive latch for normally retaining said sheet feed head assembly against movement with said sheet stack supporting means and enabling said sheet feed head assembly to move with said sheet stack supporting means on exertion of sufficient force on said sheet feed head to overcome said passive latch.

18. In a reproduction apparatus for making copies of original information respectively on individual sheets of receiver material, apparatus for feeding such sheets seriatim from a sheet supply stack along a feed path, said sheet supply and feeding apparatus comprising:

a platform for supporting a supply stack of individual sheets of receiver material;

means for locating said platform within said reproduction apparatus in operative relation thereto or remote from said reproduction apparatus to enable a sheet supply stack to be readily loaded on said platform;

a sheet feed head assembly locatable within said reproduction apparatus in operative relation thereto or remote from said reproduction apparatus, said sheet feed head assembly including a plenum, a vacuum source in flow communication with said plenum, and means associated with said plenum for urging a sheet acquired by vacuum in a sheet feeding direction away from the sheet supply stack;

means for selectively elevating said platform, supporting the sheet supply stack, so as to maintain the topmost sheet in such stack at a predetermined level in spaced relation with respect to said urging means of said sheet feed head assembly;

first positive air supply means for directing a flow of air at the sheet supply stack to levitate the top several sheets in the supply stack to an elevation enabling the topmost sheet to be acquired by vacuum from said sheet feed head assembly plenum, wherein said first air supply means includes a source of pressurized air and a nozzle in flow communication with said pressurized air source of said first air supply means said nozzle being located in a plane substantially coincident with the center of the supported sheet stack in a direction transverse to the sheet feed direction, and oriented so as to aim a stream of pressurized air at the top portion of a sheet supply stack supported on said stack supporting means; and second positive air supply means for directing a flow of air at an acquired sheet to assure separation of any additional sheets adhering to such topmost sheet, wherein said second air supply means includes a source of pressurized air and a plurality of nozzles in flow communication with said pressurized air source of said second air supply means said nozzles are oriented so as to aim a stream of pressurized air with a component in the direction opposite to the sheet feeding direction, toward the sheet supply stack, substantially parallel to the air stream of said first air supply means and downstream of the aim of the air stream of said first air supply means.

19. The sheet feeding apparatus of claim 18 wherein said vacuum source is selected to provide an air flow in the range of approximately between 35–60 cu. ft./min.

20. The sheet feeding apparatus of claim 18 wherein said pressurized air source of said first air supply means is selected to provide a stream of pressurized air of a flow in the range of approximately between 1.5–4.5 cu. ft./min. sufficient to travel through the supported stack and exit at the rear of such stack in a direction opposite to the sheet feed direction.

21. The sheet feeding apparatus of claim 18 wherein said nozzle of said first air supply means is of a cross-sectional shape substantially approximating a tear drop, the dimension at the top portion of the tear drop being approximately one-half the dimension of the bottom portion of the tear drop.

22. The sheet feeding apparatus of claim 18 wherein said sheet supply stack supporting means includes a platform for supporting the supply stack of sheets, and a front stop, side stops, and an adjustable rear stop for accurately locating the sheet supply stack on said platform, and said front stop including a pair of spaced upstanding fingers for guiding levitated top sheets of the sheet supply stack while permitting substantially unimpeded flow of air from said first positive air supply means therebetween, said rear stop including means for urging the top sheets in the sheet supply stack toward said front stop.

23. The sheet feeding apparatus of claim 22 wherein said urging means of said rear stop is a leaf spring.

24. The sheet feeding apparatus of claim 18 wherein said plenum of said sheet feed head assembly includes a corrugation surface facing a sheet supply stack on said stack supporting means, and wherein said sheet urging means of said sheet feed head assembly includes at least one belt entrained for movement about a closed loop path, said plenum being located within such closed loop path.

25. The sheet feeding apparatus of claim 18 wherein said plurality of nozzles are respectively of substantially semicircular cross-section and direct a stream of pressurized air of a flow for each nozzle in the range of approximately between 1.5–4.5 cu. ft./min.

26. The sheet feeding apparatus of claim 18 wherein said sheet feed head assembly and said sheet stack supporting platform include means for coupling sheet feed head assembly and said sheet stack supporting platform together to enable them to be selectively moved together transverse to the sheet feed direction to a remote location, or moved such that only said stack supporting platform moved transverse to the sheet feed direction to a remote location.

27. The sheet feeding apparatus of claim 26 wherein said coupling means further includes a passive latch for normally retaining said sheet feed head assembly against movement with said sheet stack supporting platform and enabling said sheet feed head assembly to move with said sheet stack supporting platform on exertion of sufficient force on said sheet feed head to overcome said passive latch.

28. A method for feeding sheets seriatim from a sheet supply stack, said method comprising the steps of:

supporting the sheet supply stack so as to maintain the topmost sheet in such stack at a predetermined level;

directing a first flow of positive pressure air at the sheet supply stack in a plane substantially coincident with the center of the supported sheet stack in a direction transverse to the sheet feed direction to levitate the top several sheets in the supply stack to an elevation above said predetermined level, wherein the flow rate for the positive pressure air to levitate the top several sheets in the supply stack is selected to be in the range of approximately between 1.5–4.5 cu. ft./min.;

acquiring the topmost sheet from the stack by vacuum, wherein the flow rate for the vacuum for acquiring the topmost sheet from the stack is selected to be in the range of approximately between 35–60 cu. ft./min.;

directing a second flow of pressurized air at an acquired sheet with a component in the direction opposite to the sheet feeding direction, toward the sheet supply stack, substantially parallel to the first flow of positive pressure air, and downstream of the aim of the first flow of positive pressure air to assure separation of any additional sheets adhering to such topmost sheet, wherein the flow rate for the positive pressure air to assure separation of any additional sheets adhering to such topmost sheet is selected to be in the range of approximately between 9–27 cu. ft./min.; and urging a sheet acquired by vacuum in a sheet feeding direction away from the sheet supply stack.

* * * * *